United States Patent [19]

Salts

[11] 3,939,238

[45] Feb. 17, 1976

[54] METHOD FOR MANUFACTURE OF FACING BRICKS WITH SHARPLY DELINEATED PORTIONS OF DIFFERENT COLOR AND TEXTURE

[75] Inventor: Thomas R. Salts, Amarillo, Tex.

[73] Assignee: Crowe-Gulde, Inc., Amarillo, Tex.

[22] Filed: Dec. 28, 1973

[21] Appl. No.: 429,085

Related U.S. Application Data

[62] Division of Ser. No. 265,548, June 23, 1970, Pat. No. 3,799,716.

[52] U.S. Cl. ..... 264/71; 264/74; 264/245; 264/256; 264/309; 264/327; 264/DIG. 72; 425/DIG. 121; 427/282

[51] Int. Cl.[2] ..... B28B 1/08

[58] Field of Search ..... 264/62, 71, 74, DIG. 72, 264/245, 256, 309, 327; 117/70 D, 70 S; 118/112, 302; 427/282

[56] References Cited

UNITED STATES PATENTS

| | | | |
|---|---|---|---|
| 1,641,048 | 8/1927 | Poston | 425/DIG. 121 |
| 1,807,858 | 6/1931 | Morris | 425/DIG. 121 |
| 2,191,106 | 2/1940 | Denison | 264/62 |
| 2,574,675 | 11/1951 | Walker | 118/301 X |
| 2,588,595 | 3/1952 | Warner | 118/112 X |
| 3,422,793 | 1/1969 | Lachmann | 118/301 |
| 3,621,086 | 11/1971 | Gulde | 264/71 |

*Primary Examiner*—Robert F. White
*Assistant Examiner*—Thomas P. Pavelko
*Attorney, Agent, or Firm*—Ely Silverman

[57] ABSTRACT

Processes for coating concrete bricks with exposed surfaces having sharply delineated portions of contrasting color and/or texture by periodically and regularly forming atomized particles of a viscous cementitious slurry and directing same on to portions of surfaces of each of a plurality of green concrete bricks in groups located stationary in regular fashion for a brief period and thereafter firing the thus coated uncured brick. The processes include steps for rapidly and/or sequentially varying the colors applied to the different groups of bricks during successive cycles of coating the successively treated different groups of such brick.

7 Claims, 16 Drawing Figures

FIG. 1
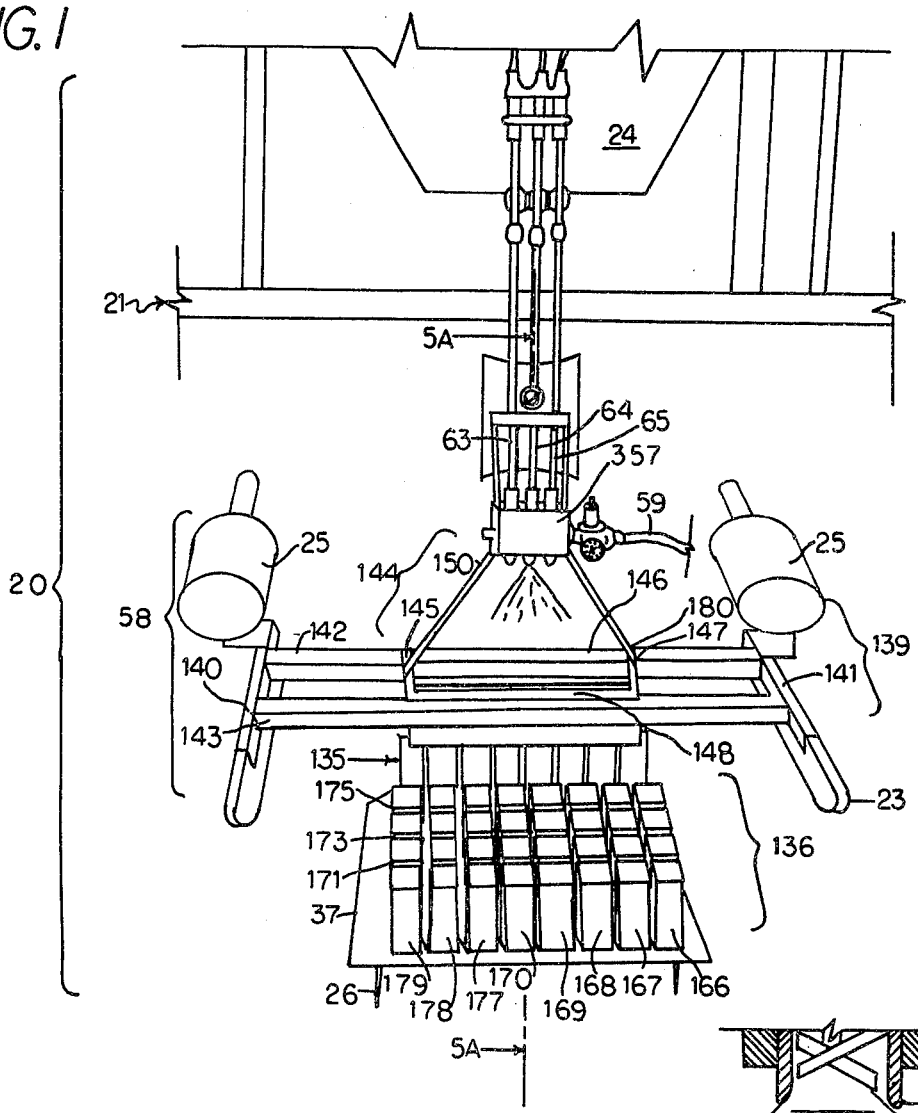
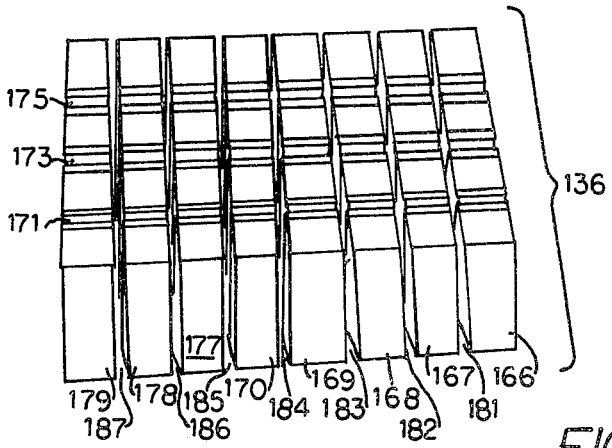
FIG 2
FIG 3
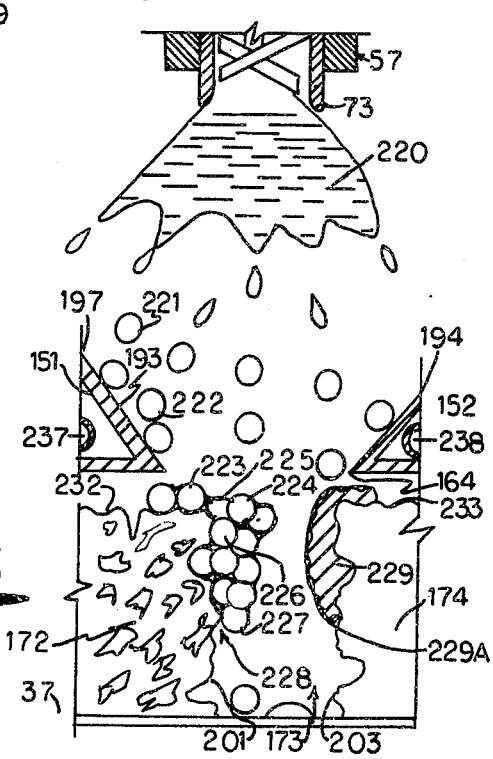

FIG. 7
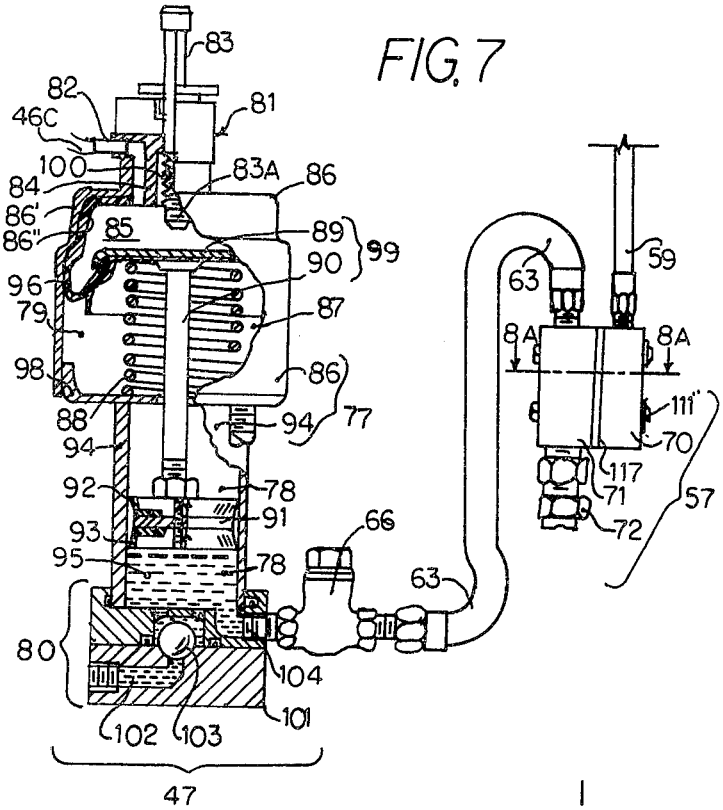
FIG. 8
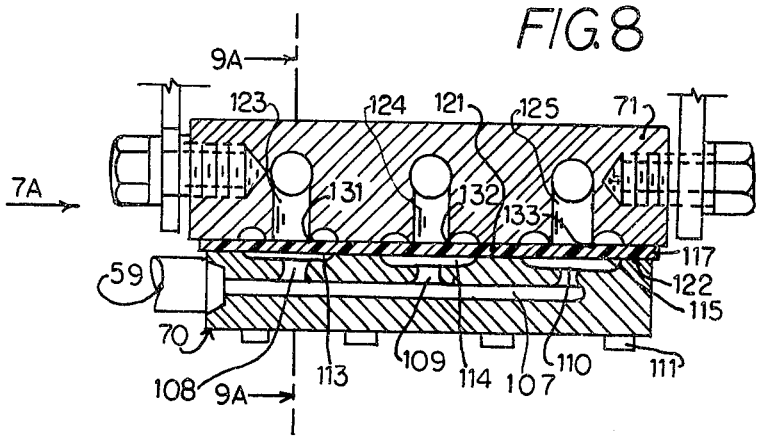
FIG. 9
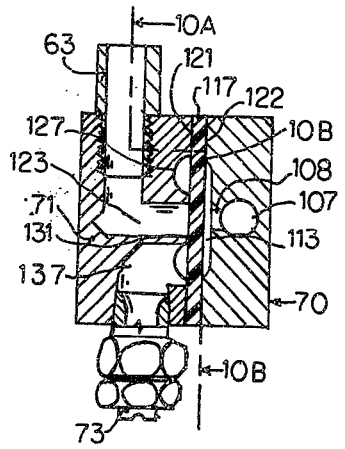
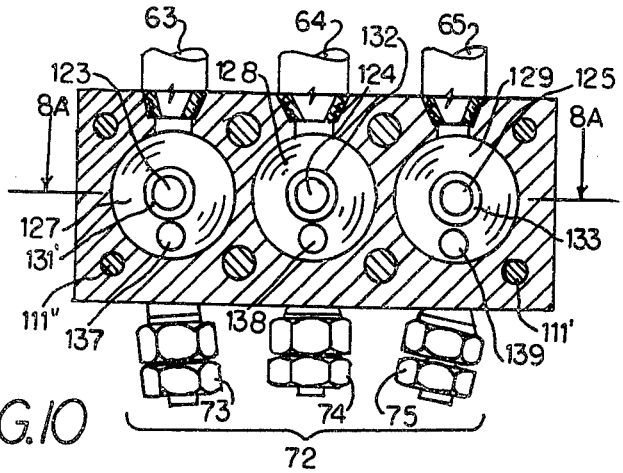
FIG. 10

METHOD FOR MANUFACTURE OF FACING BRICKS WITH SHARPLY DELINEATED PORTIONS OF DIFFERENT COLOR AND TEXTURE

CROSS REFERENCE TO RELATED APPLICATION:

The application is a division of my co-pending application Ser. No. 265,548, filed June 23, 1972 now U.S. Pat. No. 3,799,716, issued Mar. 26, 1974, entitled "APPARATUS FOR MANUFACTURE OF COATED BRICKS".

BACKGROUND OF THE INVENTION

1. The Field of the Invention

The fields of art to which this invention pertains are methods of coating for a concrete product.

2. Description of the Prior Art

The prior art teaches rapidly paced high speed block making machines as in U.S. Pat. No. 2,366,780 operating at repeated cycles of 10 to 15 seconds duration and slowly spaced coating processes for coating concrete surfaces one at a time as in U.S. Pat. No. 2,806,277. Such procedures have not provided an economically produced yet attractive facing brick as desired by the market. Also prior art as U.S. Pats. No. 3,621,086 and 3,425,105 provide for making multicolored concrete bricks but without sharp delineation of different colored and textured surface portions thereof.

SUMMARY OF THE INVENTION

The rough and selectively adsorptive surface characteristics of uncured concrete brick and the selectively non-adhesive properties of finely atomized cementitious slurries are utilized to locate small atomized aggregates of cementitious slurries at predetermined limited portions of uncured concrete brick surfaces; such atomized slurries are produced by a sharply cut off high pressure spray so that a sharply defined layer of particular range of thickness is produced that is adequately mechanically stable, yet optically opaque when cured. The apparatus is arranged to provide rapid change of the composition and/or color of the coating layer. The sharp delineation of differently textured and colored portions accentuate the texture and color characteristics and produce particularly attractive architectural products.

BRIEF DESCRIPTION OF THE DRAWINGS

FIG. 1 is a perspective front view of apparatus 20 showing a portion of the block making machine 21 and a slurry forming and distributing apparatus 22 of the invention in normal operative combination;

FIG. 2 is a front and top oblique view of the treated group of uncured bricks as seen along the direction of arrow 2A in FIG. 4;

FIG. 3 is a diagrammatic representation of the atomization and selective coating operation performed by the apparatuses of this invention;

FIG. 7 is a vertical sectional longitudinal view of a pump 47 and a side view along the direction of the arrow 7A of FIG. 8 of the nozzle assembly 57 connected thereto. The units here shown are located in zone 7A of FIG. 4;

FIG. 8 is a transverse horizontal sectional view along the transverse section 8A—8A of FIG. 10.

FIG. 9 is a transverse vertical sectional view along the plane 8a–8B–8C of FIG. 8.

FIG. 10 is a longitudinal sectional view along the broken section 10A–10B–10C.

Figure 4:
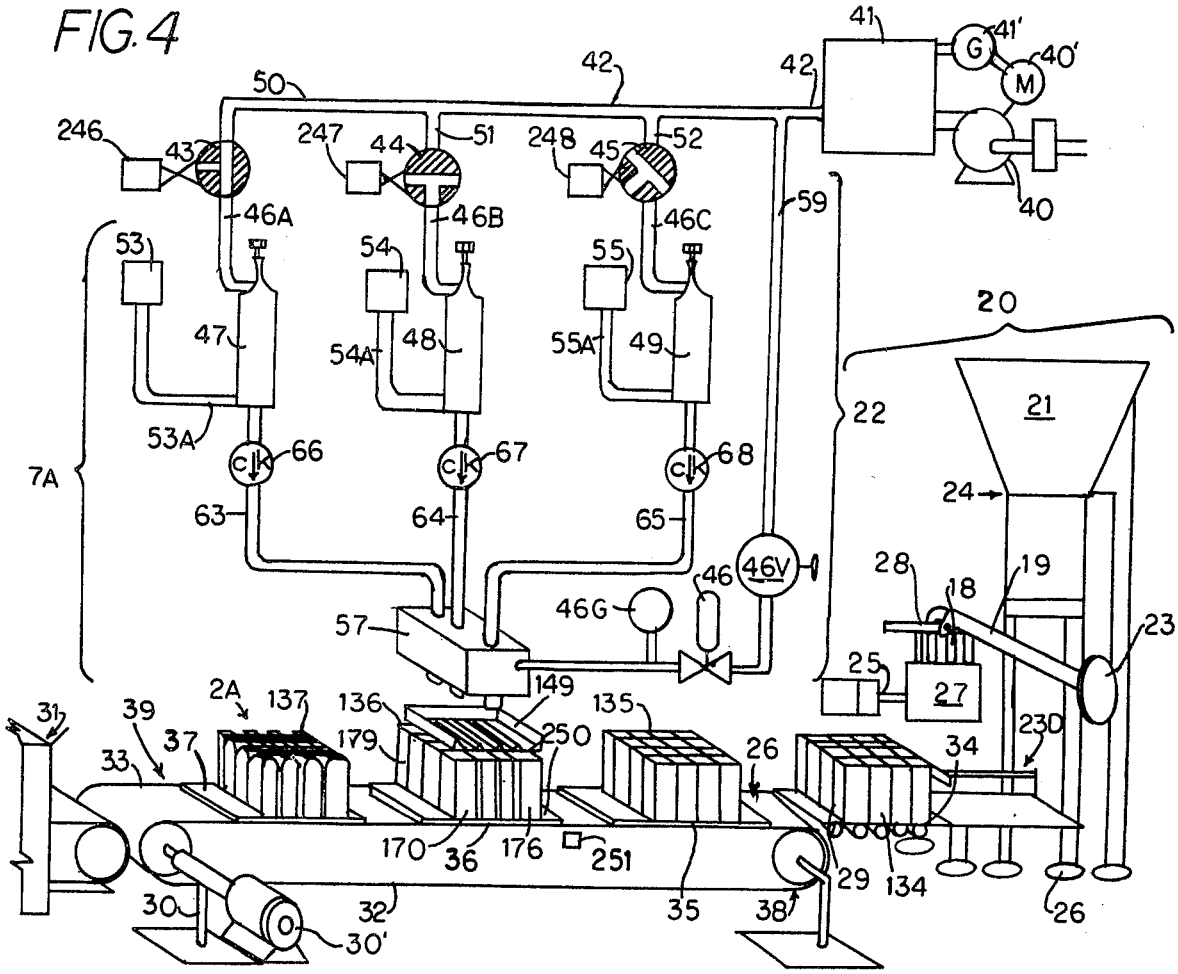
FIG. 4 is a diagrammatic piping and valve connection and conveyor unit of assembly 22 and bricks treated thereby.

The apparatus 20 according to this invention performs the process and provides the products of this invention and comprises a blockmaking apparatus 21 in operative combination with a slurry forming and distributing subassembly 22.

The apparatus 320 according to this invention performs the process and provides the below assembled products of this invention and comprises a blockmaking apparatus 21 in operative combination with a slurry forming and distributing subassembly 322.

The apparatus 21 is a standard blockmaking machine such as in U.S. Pat. No. 2,366,780. It comprises a bin and chute subassembly 24, with a feed distributor subassembly, a motor and frame subassembly 23, a mold and vibrator subassembly 25, a stamp and stripper subassembly 28, and a pallet feed and conveyor subassembly 26. The mold and vibrator subassembly 25 comprises a mold frame 27 with a plurality of like rectangular mold chambers therein.

The motor and frame subassembly 23 is provided with a feed drawer motor and discharge subassembly 23D which is arranged to discharge the completed blocks (as in U.S. Pat. No. 2,366,780).

The stamp and stripper subassembly 28 comprises a set of stamps 18 which match and enter the chambers in the mold frame 27 and a movable stamp support frame 19 for stamp set 18.

The conveyor subassembly 26 comprises the conveyor frame 30 which supports drive wheels and on which are supported conventional conveyor chains 32 and 33 and on which chains are supported flat pallets as 34, 35, 36, and 37. The conveyor feed portion 38 passes pallets as 34 and 35 from the supports therefor below the mold frame 23. The pallets as 34 receive the array 29 of green or plastic bricks formed by apparatus 21, such pallet and array move away from the frame assembly 23 along the discharge portion 39 of the conveyor 26. Details of such conventional structures are given in U.S. Pat. No. 2,366,780.

The apparatus 21 of apparatus 320 also is a standard blockmaking machine such as in U.S. Pat. No. 2,366,780 and may have the pigment slurry spraying subassembly, as 19 in U.S. Pat. No. 3,621,086, of which the slurry pipe and valve assembly 394 (assembly 94 of U.S. Pat. No. 3,621,086), a slurry flow and spray control assembly 396 (assembly 96 of U.S. Pat. No. 3,621,086) and a slurry tank 392 (assembly 92 of U.S. Pat. No. 3,621,086) are operatively attached. This pigment slurry spraying subassembly may also be attached to the apparatus 21 in the apparatus 20.

The spray sequence control of subassembly 450 (150 of U.S. Pat. No. 3,621,086) is operatively connected to and actuated by the drive mechanism and support 19 for stamp 28 of apparatus 21.

The conveyor assembly 26 of apparatus 320 is the same in structure and function as in assembly 21 of FIGS. 1 and 4.

The slurry forming and distributing assembly 22 comprises a compressed air tank 41, remotely controlled control valves 43 44 45, and 46, like slurry pumps 47, 48, and 49, like slurry tanks 53, 54, and 55, a nozzle assembly 57 and a nozzle support assembly 58.

As diagrammatically shown in FIG. 4 the compressed air tank 41 is supplied by air pump 40 and such pump is driven by a motor 40'; a pressure guage 41' is connected to motor 40' and maintains the pressure in tank 41. The outlet of tank 41 is connected by exhaust manifold 42 to (a) air tank distribution lines 50, 51, and 52 and therethrough to three-way control valves 43, 44, and 45 and (b) by air tank distribution line 59 to nozzle assembly 57. Each of valves 43, 44, and 45 in one position thereof connect lines 50, 51, and 52 respectively, via control valve discharge lines 46A, 46B, and 46C respectively to slurry pumps 47, 48, and 49 respectively. Slurry tanks 53, 54, and 55, respectively, are operatively connected by lines 53A, 54A, and 55A respectively to the inlets of pumps 47, 48, and 49 corresponding to inlet passage 102 of pump 47. The slurry pumps 47, 48, and 49 are connected at their outlet as 104 of pump 49 by slurry pump discharge lines 63, 64, and 65, respectively, to the nozzle assembly 57. The nozzle assembly 57 is supported on the nozzle assembly support 58: support 58 is located over the pallet feed and conveyor assembly 26 of the block making machine 21.

The slurry pump 47 comprises a rigid cylindrical pump housing 77 which in turn is composed of a topmost head 81, an upper cylindrical air chamber wall 86 and a lower cylindrical piston cylinder wall 94 firmly and co-axially joined. This housing 77 is located on top of and affixed to a pump base 80.

The housing 77 surrounds a driving piston chamber 78 in wall 94 and a control cylinder chamber 79 in wall 86 thereabove. The control cylinder chamber 79 comprises an upper air chamber 85 and a lower spring chamber 87. The head 81 is a rigid casting which includes a high pressure air inlet and passage 82 and a sealing packing head and passage for an adjustment bolt 83. An air passage 84 extends from the air inlet and passage 82 through the head 81 to the upper air chamber 85. The air chamber wall 86 is a double wall having an outer wall 86' and an inner wall 86''. The lower edge of the inner wall 86' firmly grasps a flexible seal 96. The lower spring chamber 87 supports therein a compressed spring 88 and a piston 99. The piston 99 comprises a piston control head 89 which is a flat rigid double sheet of imperforate metal which is firmly and rigidly attached at its center to a rigid vertical piston shaft 90. The lower end of the shaft 90 is firmly fixed to a circular piston frame 91 and that frame supports upper and lower cylindrical piston seals 92 and 93. Seals 92 and 93 in fluid-tight manner firmly yet slidably engage the inner surface of the piston cylinder wall 94.

The lower end of the spring 88 is firmly supported on the shoulder 98 of the air chamber wall 86 and forces the piston head 89 upward. The adjustment nut 83 is rigid and adjustably positioned by its male threads in thread portion 100 in the head portion 81 of the pump housing. The bottom portion 83A of the adjustment bolt 83 firmly contacts the top surface of the piston head 89 at the desired uppermost position of the piston assembly 99 and thereby fixes the length of travel of the piston frame 91 in the piston cylinder wall 94 and thereby adjusts the amount of liquid slurry displaced from the driving cylinder chamber 78 at each actuation of the piston assembly 99. The piston assembly 99 is actuated and moved downwards (as shown in FIG. 7) by the passage of air into the chamber 85 through the line as 46C the passage of air through which (line 46C) is controlled by the valve 45, valve 45 is, in turn controlled by the timing mechanism diagrammatically shown in FIG. 11.

Slurry pumps 47, 48, and 49 each have the same structure and operation as hereinabove discussed for the slurry pump 47. The control of movement of the piston 91 in each pump as 47 is effected by control of the passage of high pressure air through the air line as 46A thereto: air line 46B acts for pump 48 as does line 46A for pump 47 to control the amount of slurry passed from tank 54 into pump 48. Line 46C and valve 45 provide for the control of passage of air from tank 41 into the pump 49 and lines 54A and 55A provide for passage of the slurry tanks 54 and 55 respectively into the pumps 48 and 49 as described for pump 47. Further, as the control of the piston 91 in pump 47 is adjusted by an adjustment nut 83, similarly, the amount of piston movement in each pump as 48 and 49 is similarly controlled by a similar adjustment nut therein.

The base 80 comprises a heavy rigid base block 101 with an inlet passage 102 therein which leads to the bottom of the driving piston chamber 78 below the lower piston seal 93, as shown in FIG. 7. The bottom of driving piston chamber 78 below the seal 93 is open to an outlet channel 104 in the base block 101. This piston chamber outlet channel 104 is operatively connected through an outlet check valve 66 to the line 63. The line 63 is connected to the nozzle assembly base 71 of the nozzle assembly 57. A similar piston chamber outlet channel in pumps 48 and 49 are connected by check valves 67 and 68 respectively to lines 64 and 65 respectively to nozzle assembly 57 as shown in FIG. 3.

Nozzle assembly 57 comprises a top plate 70 and a nozzle assembly base 71 and a plurality of nozzles 73, 74, and 75 operatively joined together as hereinbelow described.

The nozzle assembly top plate 70 is a rigid steel plate in shape of a rectangular prism provided with a longitudinally extending straight cylindrical manifold passage 107 with branch conduit lines 108, 109, and 110 therefrom. The branch conduit lines are each of the same size and cylindrical shape and are each located with the central longitudinal axis thereof at the geometric center of a corresponding circular chamber, with branch line 108 entering the top of circular top chamber 113 at its center, branch line 109 entering the top of a circular top chamber 114 at its center. An imperforate elastic diaphragm sheet 117 located between and firmly held to and between plates 70 and 71.

Bolts as 111, 111′, and 111″ pass through the plate 70 and 71, sheet 117 and hold it firmly to elastic diaphragm sheet 117 and to nozzle base block 71.

The nozzle assembly base 71 is a rigid metal block in shape of a rectangular prism provided with a series of like right cylindrical inlet passages 123, 124, and 125 which are each co-axial with the cylindrical branch passageways 108, 109, and 110 respectively. The central longitudinal axis of each of the passages 123, 124, and 125 is coplanar with a line which is the longitudinal axis of the manifold passage 107. The longitudinal axis of manifold passage 107 is a straight line and it and the axes of passages 123, 124, and 125 all lie in the same straight flat plane. For each of the inlet passages 123, 124, and 125 a toroid shaped annular chamber 127, 128, and 129 respectively is associated therewith. Each such annular chamber is of the same size and shape: each is semi-circular in diametral transverse cross section and concave towards sheet 117 and open towards such sheet. The axis of revolution of each such annular chamber and section is co-axial with the passage associated therewith; that is, annular chamber 127 is co-axial with the inlet passage 123, annular chamber 128 is co-axial with inlet passage 124 and annular chamber 129 is co-axial with inlet passage 125. A narrow circular shoulder 131 which is co-axial with inlet passage 123 separates inlet passage 123 from the annular chamber 127; a narrow circular shoulder 132 co-axial with inlet passage 124 separates that inlet passage 124 from annular chamber 128; and a narrow circular shoulder 123 of the same size as shoulders 131 and 132 separates the inlet passage 125 (which has the same diameter as passages 123 and 124) from the annular chamber 129 which chamber has the same interior and exterior diameter and the same depth and shape as do the annular chambers 127 and 128. The shoulders 131, 132, and 133 extend to the same flat plane as the diaphragm surface 121 of the nozzle assembly base 171. The nozzle assembly top plate 70 has a bottom flat diaphragm surface 122: the diaphragm plate 117, which is when no unbalanced pressure is applied thereto flat on both sides, is an imperforate and flexible sheet and is located between faces 121 and 122.

The nozzle support assembly 58 is composed of a base frame 139, a center frame 144 and a grid 149.

The base frame 139 comprises a rigid left support frame member 140 and a rigid right support frame member 141 which are spaced apart from each other and rest on the frame of the block making machine 21 as shown in FIG. 1. Front and rear transverse frame members 142 and 143 respectively are spaced apart from each other and extend from members 140 to 141. These front frame members 142 and 143 are rigidly attached to the frame members 140 and 141 and also are attached to the bottom portions of the upwardly extending center frame 144 and serve to hold grid 149 in a position over the path along which the arrays of uncured bricks travel on pallets along conveyor 26 from the apparatus 21.

The center frame 144 comprises a rectangular, rigid, flat open bottom frame which comprises, firmly joined together, a rigid vertically extending front to rear left frame member 145 and a like or similar vertically extending front to rear extending thin rigid right center frame member 146. Center frame members 145 and 146 are rigid flat imperforate plates. These flat plates are spaced apart from each other by slightly more than the width of the groups of bricks as 134, 135, 136, and 137 that are moved out along the discharge pallet feed and conveyor assembly 26 of the block making machine 21 and confine the spray from the nozzle assembly 57 to the zone of the array of uncured bricks therebelow and join front and rear frame members 148 and 147.

Figure 6:
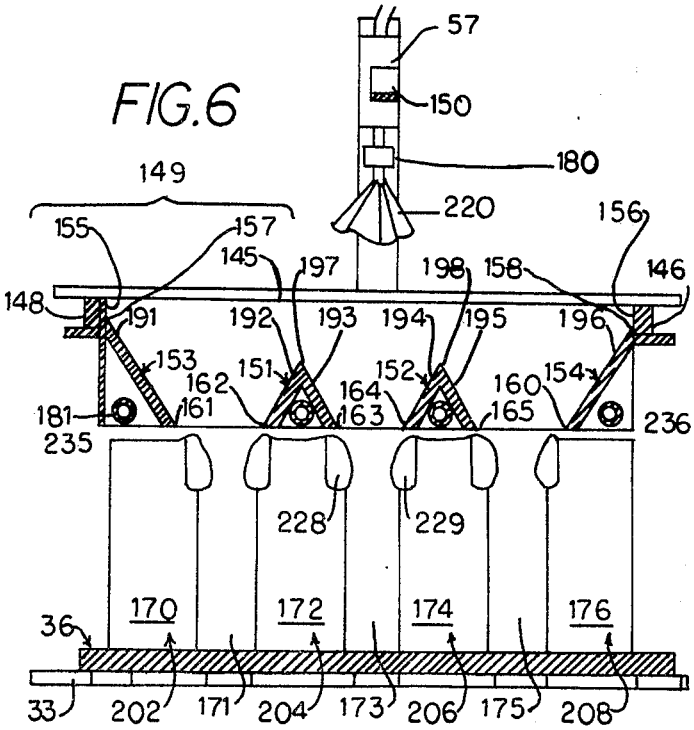
FIG. 6 is a diagrammatic vertical sectional view along plane 5A—5A of FIG. 1.

The front frame member 148 has an upper flat vertical face 155 and a lower flat oblique face 153 continuous therewith at straight junction line 157. The rear frame member 146 has an upper flat vertical portion 156 parallel to member 148 and a lower flat oblique face 154 continuous therewith at straight junction line 158. A rear transverse rib member 151 and front transverse member 152 extend from the left frame member 145 to the right frame member 146 and are firmly attached thereto. The members 151 and 152 are each triangular in shape with apex 197 and 198 respectively upward and sides 192 and 193, 194 and 195 equal in angle to the vertical and in length. The angle to the vertical of sides 191 and 193 and 192 and 194 of members 151 and 152 is the same as the angle of faces 191 and 196 of members 153 and 154: the upper edges 197 and 198 of members 151 and 152 are parallel to each other and to the line of junction 157 of faces 153 and 155 of member 148 and to the line of junction 158 of faces 154 and 156 of member 146. The front faces 192 and 194 of members 151 and 152 respectively and face 154 are parallel to each other: the rear faces 193 and 195 of members 151 and 152 and face 153 are parallel to each other. The bottom edges (as shown in FIG. 6) 161 and 160 of faces 153 and 154 and the bottom edges 162, 163, 164, and 165 of members 151 and 152 are all parallel to each other, straight and horizontal and lie in the same horizontal plane. The horizontal distance between neighboring edges as 161 and 162 and between edges 163 and 164 and between edges 165 and 166 are the same.

The center frame 144 also includes upwardly extending arms 150 and 180; these arms extend obliquely upwardly from members 145 and 147 respectively, and are firmly and rigidly attached thereto (bottom of 150 to middle of member 145, bottom of 180 to middle of arm 147) and to the sides of the nozzle assembly 57 (top of arm 150 is attached to left side of assembly 57; top of 180 is attached to the right side of assembly 57) and locate and orient the nozzle assembly 57.

The array of uncured bricks as 29—four rows of eight bricks each as shown in FIGS. 1, 2, 4, and 6—produced by the machine 21 is located on a pallet as 34 and is moved by the conveyor 26 towards and under the center frame 144 of the nozzle assembly support 58. The arrays 29, 135, and 136 are identical. The uncured blocks of the array 136 are arranged, as shown in FIGS. 1 and 2, in a transversely extending series of longitudinally rows of bricks, of which rows the front member is numbered 166, 167, 168, 169, 170, 177, 178, and 179 (FIG. 2) and such rows are separated from each other longitudinal extending spaces 181, 182, 183, 184, 185, 186, and 187 respectively which extend parallel to length of conveyor 26 as shown in FIGS. 1 and 2.

For any one such row of such bricks as shown in FIGS. 1 and 6, the bricks 170, 172, 174, 176 in each such row extend parallel to length of conveyor 26 and are separated by transversely extending spaces 171, 173, and 175; the spaces 171, 173, and 175 extend transversely across the entire array 29. Each successive array of bricks, as 29, is moved from assembly 21 along successive positions on conveyor 26 for array 135 and 136. The slurry is applied to the array at the position thereof on conveyor 26 below nozzle assembly 57 as shown as 136 in FIGS. 1 and 4. The array 136, as well as conveyor 26, are then stationary.

In the position of array 137 the distance between each pair of adjacent bottom edges as 161 and 162, 163 and 164, 165 and 160 of grid 149 has its center in a position which is vertically over the center of the spaces as 171, 173, and 175 between the rows of brick therebelow. Thereby the members 151, 152, 153, and 154 serve to guide the slurry passing from the nozzle 57 to the transversely extending spaces as 171, 173, and 175 between the longitudinally spaced bricks as 170, 172, 174, and 176 of each longitudinally extending row of bricks (as the longitudinally extending rows represented by the front members thereof 166, 167, 168, 169, 177, 178, and 179 as well as 170) in the array as 136, and shown after treatment as array 137.

The nozzles 73, 74, and 75 are adapted for spraying of slurries, as in U.S. Pat. Nos. 2,098,136 or 3,104,829 and convential.

The upper surfaces 191, 192, 193, 194, 195, and 196 of the transversely extending members are fully covered by a smooth layer of enamel paint: the slurry does not adhere thereto. The surface may be otherwise prepared or treated for such effect to achieve a selectively differential wetting action by the atomized slurry particles whereby the slurry selectively adheres to the concrete brick surface but not to the guide surfaces 191–196 of grid assembly 149.

The block making machine 21 automatically and continually produces a group or array of uncured blocks, as 29, every 15 seconds as described in U.S. Pat. Nos. 3,621,086 and 2,366,780. On completion of each cycle of production of such an array, as 29, that group or array is placed on a pallet, as 34 and that pallet and group or array are moved along conveyor 26; accordingly the group or array 29 is moved by a series of stepwise translations along conveyor 26 to successive positions, as shown for arrays 135, 136, and 137 in FIG. 4 and located in each such position for the period of time required for production of another group or array of uncured bricks as 29; after such period of time each array is moved to the next position; during such period of time the array is stationary. When the array of green blocks is below the nozzle assembly 57 and is stationary slurry is applied thereto from the assembly 57 by operation of the slurry assembly 22 to produce a composite structure for each slurry-coated bricks as shown in FIGS. 2, 4, and 6. The resulting slurry coated bricks are then passed into kiln 31 and formed into fired or cured bricks with a partial coating of a glazed slurry.

The operation of the apparatus 22 provides a selective application of the slurry to limited portions of the concrete bricks in the array as 137 below the nozzle assembly 57 which results as shown in FIGS. 2, 4, and 6 in a partial fractional coverage of selected faces of the brick as faces 201 and 203 of brick with the slurry which is composed of small sized particles. The slurry so applied and located, on firing forms a relatively smooth surfaced strongly colored glazed zone with a sharply defined edge; the bright color and smooth texture of such glazed zone are accentuated by the immediately adjacent coarser and relatively duller or differently colored concrete surface.

The fired slurry has a coefficient of thermal expansion that is slightly different from the body of the brick, no resultant substantial stress develops because the partially coated bricks are only 2½ inch wide and are separated by mortar, and the fired slurry has substantially the same coefficient of expansion as the mortar between the bricks.

In operation of apparatus 22 on injection of slurry from one pump, as 47, (or more than one pump as 47, 48 and 49 each nozzle as 73, 74 and 75, atomizes the slurry fed thereunto into small spheroids substantially all of less than one-sixteenth inch in diameter. As diagramatically illustrated in FIG. 3 (at enlarged scale for illustrative purposes) these small spheroids do not adhere to the smooth slurry-repellent organic surfaces 191, 192, 193, 194, 195, 196 but do adhere to (a) the upper portions of the vertical surfaces as 201 and 203 of the concrete bricks as 172 and 174 of the array 137, which surfaces are adjacent the transverse extending spaces 171, 173 and 175 and to (b) the upper portions of the vertical surfaces as 202 and 204, 206 and 208 adjacent the longitudinally extending passages as 181, 182, 183, 184, 185, 186 and 187 and the top surfaces as 232 and 233 of such bricks (shown in FIG. 5).

Figure 12:
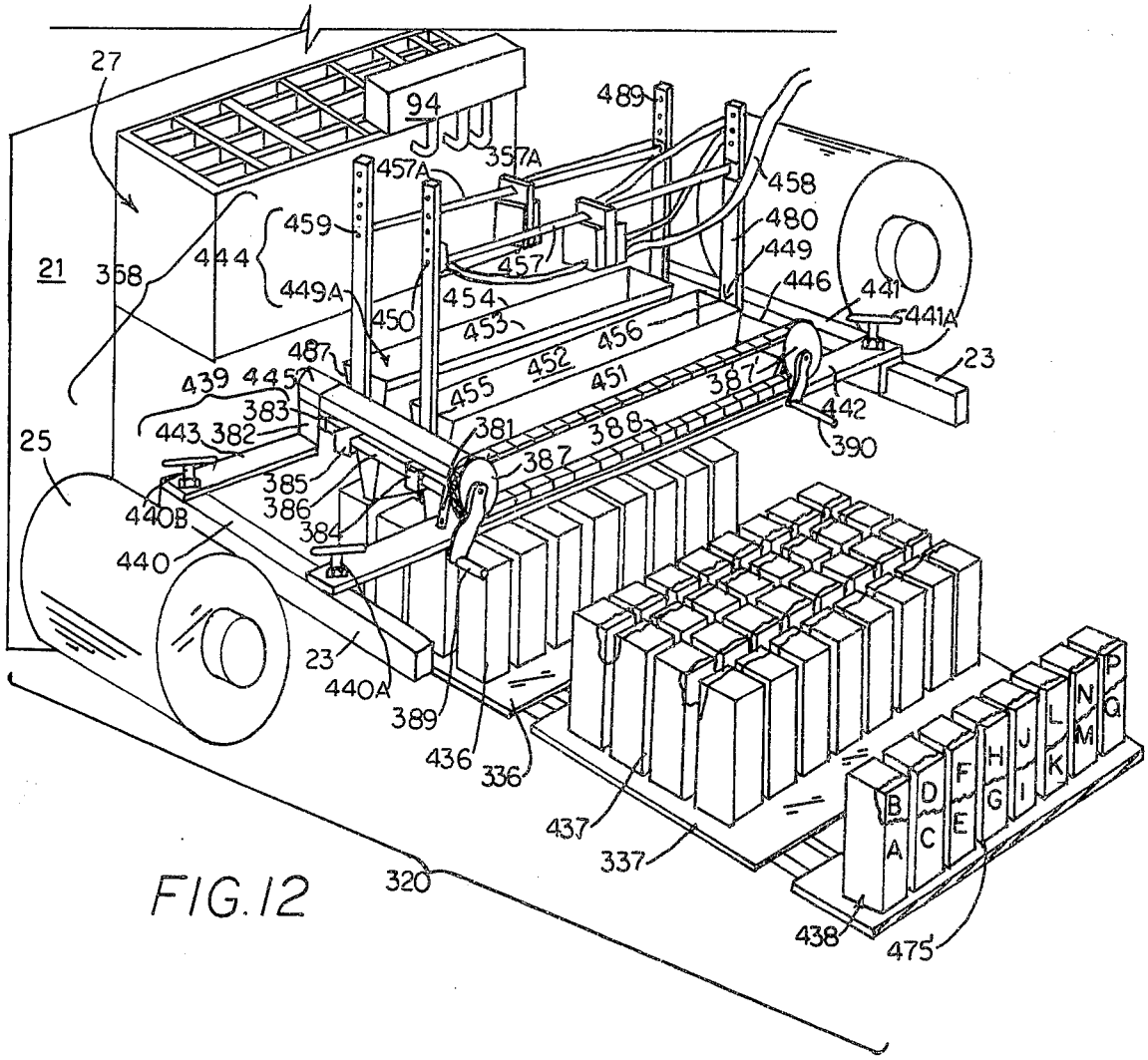
FIG. 12 is a perspective front view of apparatus 320 showing a portion of the block making machine 21 and the slurry forming and distributing apparatus 322 of the invention in normal operative combination.

The uncured concrete brick surfaces as 201 202 203 and 204 are rough and, as seen at 8X magnification, porous (as illustrated in FIG. 12 of U.S. Pat. No. 3,621,086 patented Nov. 16, 1971 and assigned to the assignee of this application) when dried and, also damp and cool while uncured. The size distribution of the aggregate used for such concrete brick is as given in Table I below. The uncured bricks as 172 174 and 176 of arrays 29 and 236 at their exterior surfaces and interior have a 5% moisture content and are, by evaporation, cooler . . . usually by about 5°F . . . than the ambient air and cooler than the guide surfaces 191–196. The slurry 220 is sufficiently "thick" or viscous that substantial pressure is required to atomize it, and, unless a hydrophyllic wet surface is met, the globules of slurry will not adhere thereto, especially when moving rapidly at an angle thereto. Accordingly, the grid surfaces do not become clogged with such slurry.

In travel from each nozzle, as 73, of nozzle assembly 57, the globules as 221–224 stream past the facing or adjacent guide surfaces as 193 and 194 of the grid members and thence at and/or over the top surfaces as 232 and 233 of the below bricks of the array as 136 as shown for bricks 172 and 174 in FIG. 3. Some of the globules or spheroids adhere to such top surfaces to subsequently form a layer on the top surface of the brick as shown at 214 and 217 in FIG. 5. The term "top" refers to the upper end of the brick in the position of the brick in the orientation thereof shown in FIGS. 1, 2, 3, 4, 5, 6 herein. Also, the turbulent flow at the top of passages as 173 (and 171 and 175) causes the droplets to impinge on the upper portions of the vertical faces on the uncured brick, as 201 and 203. The small globules or spheroids of slurry, diagramatically and in greatly enlarged scale shown in FIG. 3 as 221–226, produced from the conical spray 220 do adhere to the rough uncured moist concrete dried surface at the top surface and at the upper portion thereof adjacent the edge, as shown for globule 223: once such globules are static, the sprayed spheroids adhere to each other, and to globules as 225 and 226 adherent to the exterior vertical surface of the bricks, as shown for brick 172 for the separate globules as above described: such adherent globules form a viscous mass adequately mechanically stable to pass to and through the kiln 31: the discrete globules (for purpose of illustration and of this discussion diagramatically and to greatly enlarged scale shown in FIG. 3) form a cap 228, while a similarly structured layer is formed and is shown, in gross, as 229 on face 203 of brick 174.

Figure 5:
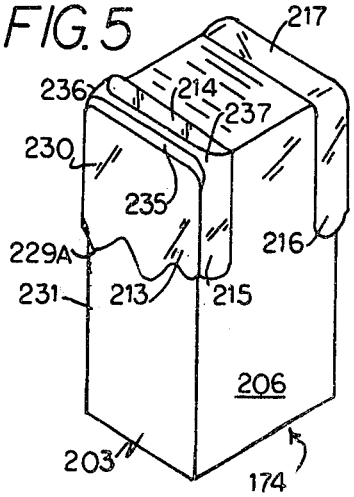
FIG. 5 is a top oblique view of a brick 174 formed according to this invention.

The globules that do not impinge sufficiently squarely on the upper portions of the vertical faces to adhere thereto fall to the upper face of the pallet, as 36, supporting the array and do not adhere to the vertical surface of the brick below the lobular but clear bottom edge, as 227, of the slurry layer as 228 (or bottom edge 229-A of slurry layer 229). The semi-fluid viscous character of the slurry mass adherent to the face, as 201 of each brick, as 172 is such that, in thin layers, i.e. layers of 1/64 to 1/16 inch thickness, as shown diagramatically in FIG. 3, 4, and 6, the slurry mass as 228, does not flow, although the lower edge thereof, as 227 does develop a slightly lobular shape and so creates, to the naked eye, in the kiln-cured finished product, as shown in FIG. 5, a sharp edge as 229A for delineation between the portion 230 of the surface of the brick covered by the cured or glazed slurry (formed from slurry layer 229) and the portion 231 of the surface of the brick not so covered.

The process of apparatus 22 thus coats a portion of surfaces of each concrete brick in array 136 by a sharply delineated cementitious layer and comprises the steps of pressurising in a pump as 47 then peridically atomizing the assembly 57 a viscous cementitious slurry 95 in pump 47 and forming atomized aggregates as 221–224 and directing such atomized aggregates towards a plurality of spaced apart sloped guide surfaces as 161–166 and a plurality of brick surfaces as 201, 203, 232 and 233 located below said guide surfaces and, for each of said bricks, applying said atomized aggregates to an area as 213, 214 and 215 on each brick as 174. Each such area is, like 230, adjacent to an upper horizontal (as FIGS. 1–6) edge as 235 parallel to edges 161–166 of grid 149: such edge is located between surface areas as 214 and 213 and joining the upper corners as 236 and 237 of such brick, as shown in FIG. 5 for purpose of illustration of the area referred to. Such area can also be defined as the areas including the top edge of the brick parallel to edges 161–165 of assembly 49, such edge also joining two upper corners of the brick and the continguous area of the vertically extending face, 203 adjacent to said edge as 236: such area extends downward to a lobulated edge as 227 or 229-A. The thickness of the layer is sufficiently small or thin to be static on said vertical face of said brick i.e. less than one-eighth inch and sufficiently thick, over one-sixty-fourth inch, to provide an optically opaque layer. The layer 228 and 229 on each uncured brick as 174 is sufficiently soft to be scratched by the back edge of a human fingernail.

The treatment of the guide surfaces as 191–196 of assembly 58 to render such surfaces pallet different from the surfaces of the uncured bricks in regard to adherence therto by the spray globules is provided by a combination of difference in (a) smoothness of the surfaces 191–196 and roughness of the uncured brick surfaces as well as (b) oleophyllic and hydrophobic character of the guide surfaces compared to the relatively oleophobic and hydrophyllic character of the uncured brick surfaces and (c) the coldness of the moist uncured brick surface compared to the relatively warmer temperature of the guide surfaces. The smoothness may be enhanced by intermittent periodic coating with waxes or the like, including spraying of wax through one of nozzles as 75 and using one pump as 49 therefor between cycles of spraying slurry through other nozzles as 47 and 48 of assembly 57 and such spraying of wax being accomplished while no part of any array of bricks is immediately below the frame 144, i.e. while the arrays on the pallets are in motion and between the times of stationary location of any such poallet and array as 29 below frame 144 and nozzle support assembly 58. The temperature difference between the guide surfaces may be accentuated by electrically or steam heated lines or hot water lines as 235, 236, 237, 238 in heat providing relationships to the sloped guide surfaces of members 151, 152, 153, 154, respectively, with forced passage of dry air past the brick surfaces to selectively cool such surfaces by evaporation prior to location of such surfaces below nozzle assembly 57.

The cement particles are 5 to 10 microns in diameter with an average surface area of 1600 square centimeters per gram: accordingly, after firing, the layer of liquid slurry is not entirely complete; neverless, the surface of the coatings as 213, 214, 215, 216 and 217 are smooth to the naked eye. This proves provides a clear destinction between the uncoated portions, as 231 and the coated portion as 230, by their different color and/or texture and the strong line of delineation therebetween.

The timing of the actuation of the spray is effected by a cam face 250 on conveyor subassembly number 26 actuating timer 242. This actuates the valve 43 and transmits air under pressure from tank 41 to pump 47 for a sufficient time for the pressure developed by piston 91 in pump 47 to overcome the pressure in manifold 107 and displace the diaphram 117 and drive out for a fixed period or time (usually one-half second) the slurry 95 in the piston chamber 78. The slurry 78 passes via line 63 toward nozzle 73 and displaces a volume of such slurry theretofore in line 63 out of the nozzle 73. Such operation of a piston as 91 at a substantially constant pressure, because of the slight resilience of conduit 63, drives out a substantially constant volume of slurry from nozzle 73, usually ½ cup per each array of 32 bricks as 29. Similarly, actuation of valve 44 or 45 will, respectively, drive slurry from tanks 54 and 55 respectively, toward an array of bricks as 136 as above described. Each such brick is 2¼ inch wide, 3⅝ inch deep and 7⅝ inch high as shown in FIGS. 1–6. Other conventional sizes may also be used.

Figure 11:
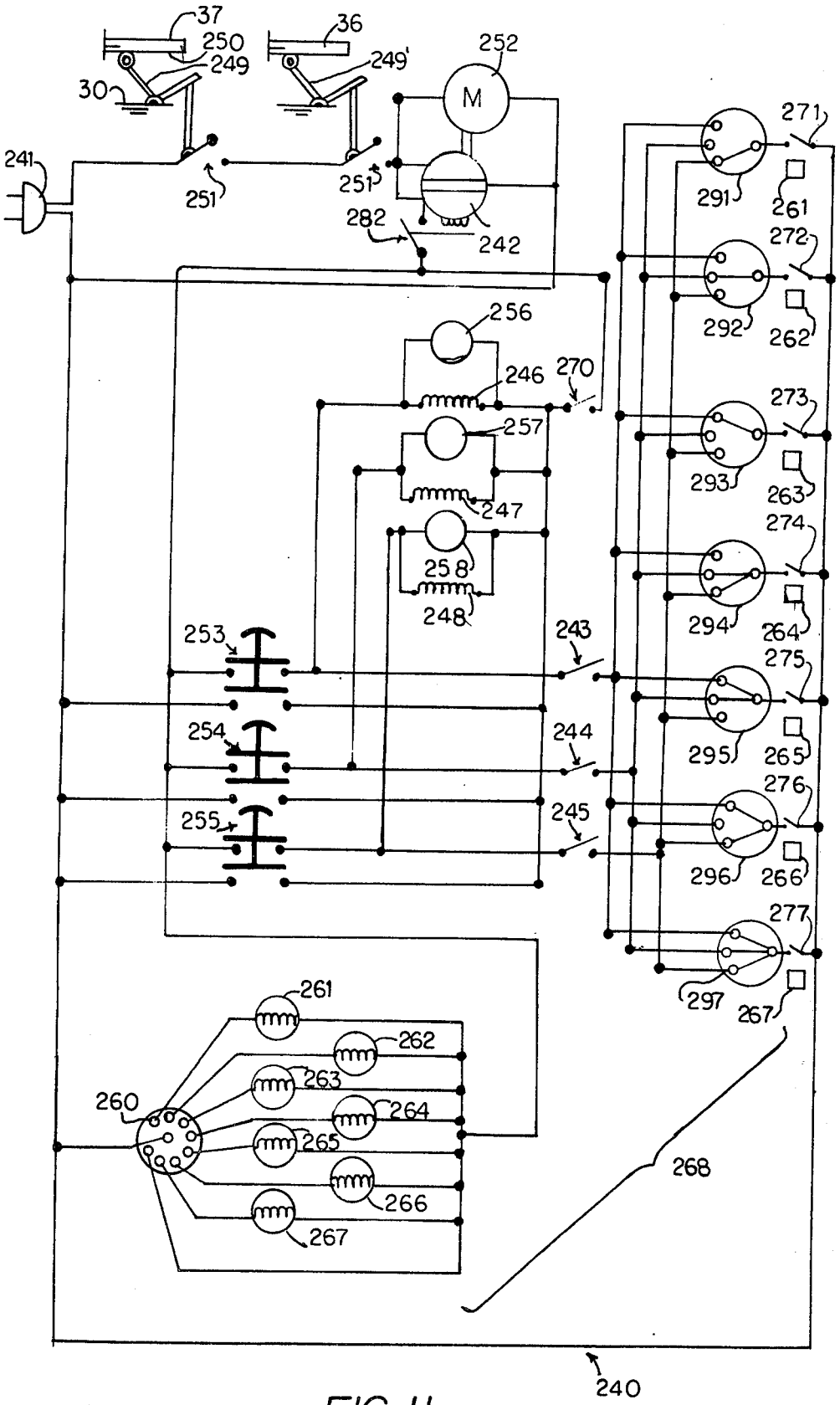
FIG. 11 is a diagrammatic wiring diagram of the electrical control mechanism of slurry forming and distributing assembly 22.

The wiring diagram for the control system 240 of the slurry forming and distributing system subassembly 22 is shown in FIG. 11. The control system 240 comprises a power source 241 (110 volts a.c. 60 cycle) a control, or limit switch 251, a timer 242 and other switches 243–245, 253–255, 261–267, 270–277, 282, and 291–297. The timer has a motor 252 therefor and controls a timer output switch 282; these elements are operatively connected as shown in FIG. 11 so that, when powered through source 241, the timer 242 will, after the limit switch 251 is closed, open and close switch 282 regularly and repeatedly in a predetermined time sequence — as 3 seconds off and 1 second on — matching operation of block making machine 21. Followers 249 and 249A of control or limit switch 251 are firmly yet pivotally supported on the frame of the conveyor 26 and are operatively connectable, as diagramatically shown in FIGS. 11, 15 and 4, to a face 250 on the pallet 36. Thereby the switch 251 is closed as a group or array of uncured blocks as 136 is properly located under the nozzle assembly 57 (or 357 and 357A in apparatus 322); the three-second delay of timer 242 for apparatus 22 provides for the separate bricks in the array being stationary when the spray of atomized slurry particles is applied thereto. A different time delay is provided when more than one spray is applied to the uncured bricks, as in FIG. 13.

Each of valve 43, 44 and 45 is controlled by a solenoid coil 246, 247 and 248 respectively. Each of solenoids 246, 247 and 248 is automatically activated by a program unit 268 and components connected thereto as below described when atuomatic switch 270 is closed and switches 243, 244 and 245 respectively (for each of solenoids 246, 247 and 248 respectively) are closed. When automatic switch 270 is open relays 246, 247 and 248 respectively may be actuated by manual switch as 253, 254 and 255. A signal light 256, 257 and 258 is connected across (in parallel with) each of coils 246, 247 and 248 respectively to indicate that each such switch is positively powered and accordingly that the corresponding valve as valve 43, 44 or 45 is operative and the corresponding nozzle, 73, 74 or 75 should then be operative to discharge slurry towards an array of uncured blocks as 136. The pressure in line 59 is set and controlled by a pressure control valve 46 and gauge 46G, with a cut off valve 46V (FIG. 4).

FIG. 4 shows valves 43, 44 and 45 in different positions for purpose of illustration of such three available positions while, during spraying operations, usually only the position shown for valve 43 (passage then full open to pump 47) and valve 44 (shown in its position to exhaust the air chamber of pump 48 - the air chamber corresponding to chamber 85 in pump 47), while valve 46 is shown with all ports of such valve closed.

Selector switch 260 of control unit 268 provides for selective activation of any of the solenoid coils 261, 262, 263, 264, 265, 266 or 267: these solenoid relay coils (261–267) respectively selectively close solenoid switches 271, 272, 273, 274, 275, 276 and 277; these solenoid switches connect to three way multiple connector (or wye) switches 291, 292, 293, 294, 295, 296 and 297 respectively to provide for actuating the one valve 48, (by switch 291) and hence the one nozzle 73, or for actuating valve 47 (by switch 292) and the one nozzle 74, or for actuating only valve 46 (via switch 291) and the one nozzle, 75, or two valves (by switch 294, 295 or 296) of the group of valves 46, 47 and 48 or all three nozzles via switch 297. Also, the switches 291–297 may be arranged to provide any sequence of discharge of tanks as 53, 54 and 55 if switch 260 is a automatic step or sequence switch, which is within the scope of this disclosure. Accordingly the color mix or texture mix applied to the brick surfaces as surfaces 201 and 203 may be rapidly changed by manually or automatically changing the position of selector switch 260 to apply to the to-be-coated surfaces, as 201 and 203, one or more atomized slurries from any or all of the slurries in tanks 53, 54, 55 via nozzles 73, 74 or 75. With more than one tank and nozzle dishcarging such atomized particles onto the brick surfaces as 201 and 203 and 204 and 206, the timer switch 242 is adjusted to maintain a shorter time of such multiples discharge.

It is within the scope of this invention that pallet and nozzle support may move together when the guide unit orifices as 463 and 464 in assembly 322 and spaces as between edge 161 and 162 and between edges 163 and 164 (and 165 and 160) in assembly 22 are transverse to the direction of travel of the pallets as 335 and 336 or 35 and 36 (as in FIGS. 1, 4, 6, 12 and 15) or such orifices are parallel thereto (i.e. parallel to the length of travel of the pallets as in FIGS. 4 and 16) whereby nozzle assemblies and arrays of bricks are in fixed spatial relation to each other, although not stationary.

The slurry forming and distributing assembly 322 comprises a slurry air tank 41, remotely controlled control valves 343, 344, 345, 346A and 346, like slurry pumps 347, 348, 349 and 349A, like slurry tanks 353, 354, 355 and 355A, nozzle assemblies 357 and 357A and a nozzle support assembly 358.

As diagrammatically shown in FIG. 12, the slurry air tank 341 is supplied by air pump 340 and such pump is driven by a motor 340'; a pressure gauge 341' is connected to motor 40' and maintains the pressure in tank 341. The outlet of tank 341 is connected by the exhaust manifold 342 to (a) air tank distribution lines 350, 351, 352 and 352A and therethrough to threeway control vlaves 343, 344, 345 and 345A and (b) by air tank distribution line 359 to nozzle assemblies 357 and 357A. Each of valves 343, 344, 345 and 345A in one position thereof connect lines 350, 351, 352 and 352A respectively, via control valve discharge lines 346A, 346B, 346C and 346CA respectively to slurry pumps 347, 348, 349 and 349A respectively. Slurry tanks 353, 354, 355 and 355A, respectively, are operatively connected by lines 353A, 354A, 355A and 355B, respectively, to the inlets of pumps 347, 348, 349 and 349A corresponding to inlet passage 102 of pump 47. Each of the slurry pumps 347, 348, 349 and 349A is connected at its outlet as 104 of pump 47 by slurry pump discharge lines 363 and 364, respectively, to the nozzle assembly 357. Slurry pumps 349 and 349A are connected at their outlet (identical to 104 of pump 47) by slurry pump discharge lines 365 and 365A, respectively, to the nozzle assembly 357A.

Nozzle assemblies 357 and 357A are supported on the nozzle assembly support 358: support 358 is located over the pallet feed and conveyor assembly 26 of the block making machine 21. Pumps 347, 348, 349 and 349A are all alike and like pump 47: threeway valves 350, 351, 352 and 352A are identical to each other and to valves 50, 51 and 52.

Slurry pumps 347, 348 and 349 each have the same structure and operation as hereinabove discussed for the slurry pump 47. The control of movement of the piston as 91 in each pump as 347 is effected by control of the passage of high pressure air through the air line as 346A thereto: air line 346B acts for pump 348 as does line 346A for pump 347 to control the amount of slurry passage from tank 354 into pump 348. Line 346C and valve 345 provide for the control of passage of air from tank 341 into the pump 349 and lines 354A and 355A provide for passage of the slurry tanks 354 and 355 respectively into the pumps 348 and 349 as described for pump 47. Further, as the control of the piston 91 in pump 47 is adjusted by an adjustment nut 83, similarly, the amount of piston movement in each pump as 348 and 349 is similarly controlled by a similar adjustment nut therein.

Figures 15, 16:
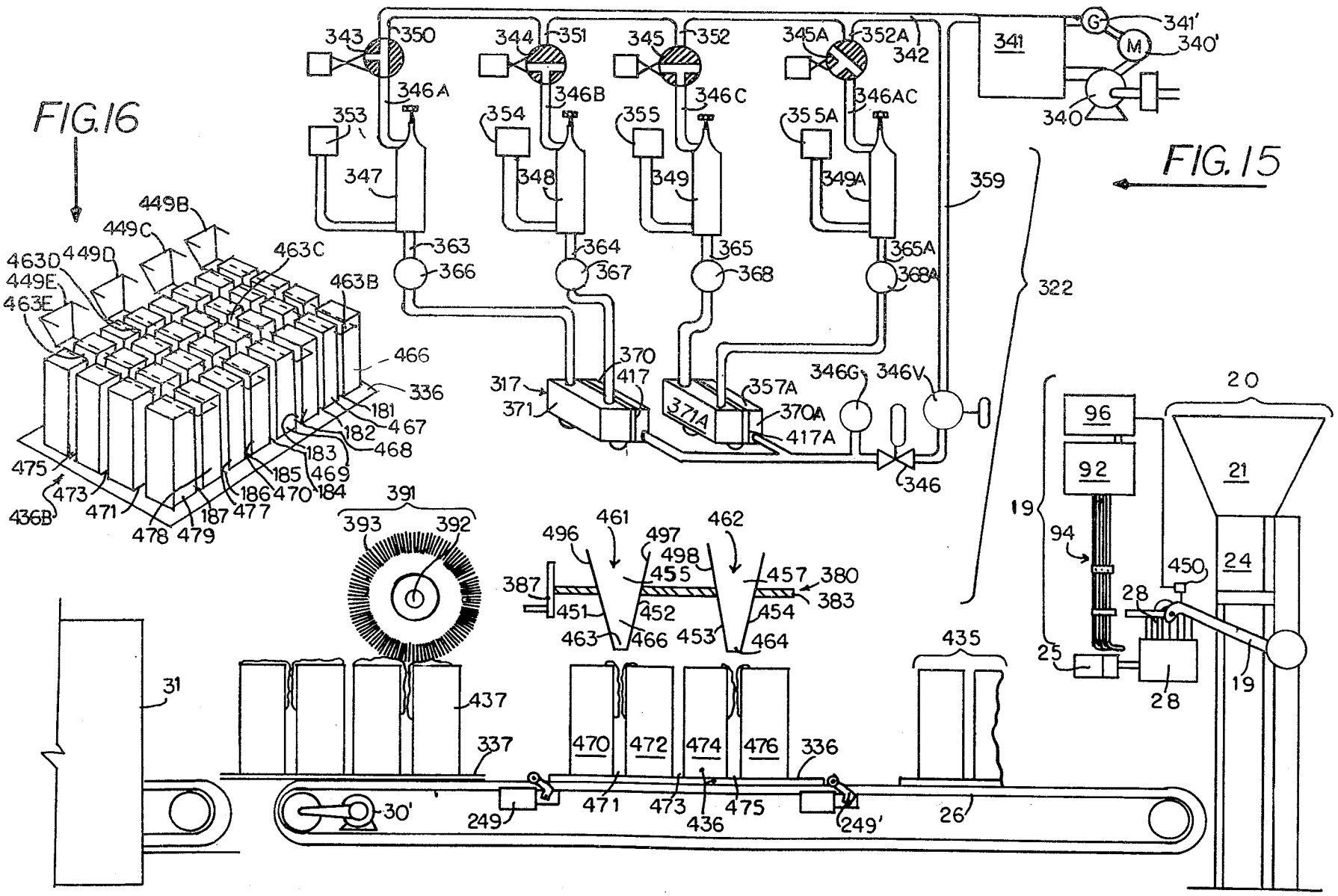
FIG. 15 is a diagrammatic piping and valve connection of and conveyor unit of assembly 22 and bricks treated thereby.
FIG. 16 is a diagrammatic top oblique view of another arrangement of spray guide assemblies relative to the array of bricks treated thereby according to this invention.

Each piston chamber outlet channel as 104 of pump 347 is operatively connected through an outlet check valve as 366 like 66). Lines 363 and 364 are connected to the nozzle assembly base 371 of the nozzle assembly 357 as lines 63 and 64 are connected to base 71. Similar piston chamber outlet channels in pumps 349 and 349A are similarly connected by check valves 368 and 368A respectively to similar lines 365 and 365A respectively to nozzle assembly 357A as shown in FiG. 16.

The nozzle assembly top plate 370 is a rigid steel plate in shape of a rectangular prism provided with a longitudinally extending straight cylindrical manifold passage like 107 with branch conduit lines like 108 and 110 therefrom. The branch conduit lines are each of the same size and cylindrical shape and are each located with the central longitudinal axis thereof at the geometric center of a corresponding circular chamber, with each branch line 108 entering the top of circular top chamber as 113 at its center. An imperforate elastic diaphram sheet like 117 located between and firmly held to and between plates 370 and 371.

Bolts pass through the plate 370 and 371 and sheet as 117 and hold it firmly to the elastic diaphram sheet and to nozzle base block 371.

The nozzle assembly base 371 is a rigid metal block in shape of a rectangular prism provided with a series of like light cylindrical inlet passages as 123, 124 which are each co-axial with the cylindrical branch passageways as 108 and 110 respectively.

The nozzle support assembly 358 is composed of a base frame 439, a center frame 444 and a pair of guides 449 and 449A.

The base frame 439 comprises a rigid left support frame member 440 and a rigid right support frame member 441 which are spaced apart from each other and rest on the frame of the blocking making machine 21 as shown in FIG. 1. Front and rear transverse frame members 442 and 443 respectively are spaced apart from each other and extend from members 440 to 441. These front frame members 442 and 443 are rigidly attached to the frame members 440 and 441 and also are attached to the bottom portions of the upwardly extending center frame 444 and serve to hold guides 449 and 449A in positions over the path along which the arrays of uncured bricks travel on pallets along conveyor 26 from the apparatus 21.

The center frame 444 comprises a rectangular, rigid, flat open bottom frame which comprises, firmly joined together, a rigid vertically extending front to rear left frame member 445 and a like or similar vertically extending front to rear extending thin rigid right center frame member 446. Center frame members 445 and 446 are rigid plates. These plates are spaced apart from each other by slightly more than the width of the groups of bricks as 435, 436 and 437 that are moved out along the discharge pallet feed and conveyor assembly 26 of the block making machine 21 as in FIGS. 4 and 1 and confine the spray from the nozzle assemblies 357 and 357A to the zone of the array of uncured bricks therebelow.

Nozzle assembly 357 comprises a top plate 370 like 70 and a nozzle assembly base 371 like 71 and a plurality of nozzles 373 and 374 operatively joined together as hereinabove described for nozzle assembly 57. Nozzle assembly 357A comprises a top plate and nozzle assembly base 371A like 71 and a plurality of nozzles 375 and 375A operatively joined as in nozzle assembly 357 as herein described; the operation of the diaphrams 417 and 417A in assemblies 357 and 357A is the same as above described for diaphram 117 in assembly 57.

The nozzle assembly top plate 370 is a rigid steel plate in shape of a rectangular prism provided with a longitudinally extending straight cylindrical manifold passage (like 107) with branch conduit lines (like 108 and 110) therefrom. the branch conduit lines are each of the same size and cylindrical shape and are each located with the central longitudinal axis thereof as the geometric center of a corresponding circular chamber, with each branch line (like 108) entering the top of circular top chamber (as 113) at its center. An imperforate elastic diaphram 417 (like 117) is located between and firmly held to and between plates 370 and 371 and operates as does diaphram sheet 117.

Bolts pass through the plate 370 and 371 and sheet 417 and hold it firmly to the elastic diaphram sheet and to nozzle base block 371 as in assembly 357.

The nozzle assembly base 371 is a rigid metal block in shape of a rectangular prism provided with a series of like right cylindrical inlet passages (as 123, 124) which are each co-axial with the cylindrical branch passageways (as 108 and 110) respectively and toroidal chambers as 127 and circular shoulders as 131 structured and interrelated as above described for base 71.

The nozzle support assembly 358 is composed of a base frame 439, a center frame 444 and a pair of guides 449 and 449A.

The base frame 439 comprises a rigid left support frame member 440 and a rigid right support frame member 441 which are spaced apart from each other and rest on the frame 23 of block making machine 21 as shown in FIG. 12. Front and rear transverse frame members 442 and 443 respectively are spaced apart from each other and extend from members 440 and 441. These transverse frame members 442 and 443 support journal frames are rigidly attached to rigid vertically extending front to rear left base frame member 445 and a like or similar front to rear extending rigid right base frame member 446. Base frame members 445 and 446 are rigid plates or ells. These plates 445 and 446 are spaced apart from each other by slightly more than the width of the guide units or guides 449 and 449A. The base frame members 440 and 441 and also are attached to and support the bottom portions of the upwardly extending center frame 444. Frame 439 serves to adjustably hold guides 449 and 449A in positions over the path along which the arrays of uncured bricks travel on pallets along conveyor 26 from the apparatus 21.

The arm 440 has front and rear vertical adjustment screws 440A and 440B for attachment to and for vertical adjustment relative to frame 23; arm 441 has like front and rear attachment and vertical adjustment screws (only 441A is shown).

The center frame 444 comprises rectangular, rigid upwardly extending vertical column members 450 and 459 and 480 and 489 and horizontal elevated transversely extending nozzle assembly positioning rod members 457 and 457A and screw adjustment units 380 and 390.

The bottom of left front vertical column member 450 and the bottom of vertical left rear column member 459 are rigidly fixed to the left side panels 455 and 457 respectively of guide units 449 and 449A respectively. The bottom of right front column member 480 and the bottom of right rear column member 489 are rigidly fixed to the right side panels 456 and 458 respectively of guide units 449 and 449A respectively.

The top of front column members 450 and 480 are each provided with a plurality of holes for rigid yet adjustable attachment thereto of a front nozzle assembly support bar 457. Bar 457 supports nozzle assembly 357. The top of each of arms 459 and 489 have similar holes to similarly provide vertically adjustable support to a rigid straight rear nozzle assembly support bar 457A: bar 457A supports nozzle assembly 357A.

Screw adjustment units 480 and 490 are alike. Unit 380 comprises a front journal 381 on member 443 and a rear journal 382 firmly attached to member 443. A lug guide bar 386 extends from the rear of each frame of each front journal as 381 to the front frame of the corresponding rear journal as 382 and such a lug guide bar is firmly fixed thereto. A left rear lug 385 is firmly fixed to the rear left side plate 457 of rear guide unit 449 : such lug 385 is supported on and adjustably movable along the guide bar 386. It may be and usually is fixedly attached thereto as by a conventional lock nut.

A left front guide lug 384 is firmly fixed to front left guide plate 455 of front guide unit 449. Such lug 384 is a rigid metal ear suppoted on and adjustably movable along guide bar 386 yet may be fixedly attached thereto notwithstanding its purpose of adjustment as hereinafter described. A left guide locator gear wheel 387 is rotatably supported in front left journal 381 and is firmly attached to the front end of a rigid helically threaded screw bar 383: bar 383 is rotatably supported at its rear end in the left rear journal 382. The screw bar 383 has a helical thread which threadedly engages a matching helically threaded hole in front left lug 384. A chain 388 engages wheel 387 of a guide adjustment unit 380 and a like wheel 387' of guide adjustment unit 390. Wheels 387 and 387' are of the same size and have the same number of teeth. Wheel 387' is firmly connected to a threaded bar identical to bar 383 which bar is helically threaded and supported on journals as 381 and 382: the right sides of units 449 and 449A have lugs as 384 and 385 that are supported on a rod as 386 and the lug on the right side of front unit 449 engages the threaded bar driven by the right guide adjustment wheel 387'. Accordingly, manipulation of the handle 389 or 389' of the guide locator gear wheels 387 and 387' adjustably and accurately positions guide unit 449 relative to the guide unit 449A for the positioning thereof relative to the laterally extending passageways as 471, 473 and 475 of array 336 (corresponding to the passages 171, 173 and 175 of array 136).

The upper faces of members 451 and 452, 453 and 454 are equal in angle to the vertical and are equal in height and length. The angle to the vertical of upper faces of members 451 and 453 of units 449 and 449A is the same as the angle of faces 452 and 454 of units 499 and 449A: the upper edges of mouths 461 and 462 and of units 449 and 449A are parallel to each other and at the same vertical level. The lower edges of openings 163 and 164 are parallel to each other and at the same level. The bottom edges (as shown in FIG. 16) 463 and 464 of units 449 and 449A are all parallel to each other, straight and horizontal and lie in the same horizontal plane. The horizontal front to rear distance between neighboring edges of opening 463 and between edges of opening 464 are the same.

The front slurry guide unit 449 comprises a front flat imperforate oblique rigid metal sheet 451 and a rear flat imperforate oblique metal sheet face 452, a flat front chamber left side wall 455 and flat front chamber right side wall 456. Both rear transverse guide member 451 and rear transverse member 452 of unit 449 extend from the left vertical side member 455 to the right vertical side member 456 and are firmly attached thereto. The chamber 466 between members 451 and 452 is trapezoidal in shape with a upper wide mouth 461 and a lower narrow orifice 463. The upper opening or mouth 461 is rectangular in shape: the lower opening or mouth 463 is rectangular in shape and are corresponding edges of openings 461 and 463 are parallel to each other.

The rear slurry guide member 449A comprises a front flat imperforate oblique rigid metal sheet 453 and a rear flat imperforate oblique metal sheet 454, a flat rear chamber left side wall 457 and flat rear chamber right side wall 458. The transverse guide member 453 and rear transverse guide member 454 of unit 449A extend from the rear left vertical side member 457 to the rear right vertical side member 458 and are firmly attached thereto. The chamber 467 between members 453 and 454 is trapezoidal in shape with a upper wide mouth 462 and a lower narrow orifice 464. The upper opening or mouth 462 is rectangular in shape: the lower opening or mouth 463 is rectangular in shape and all corresponding edges of openings 462 and 463 are parallel to each other.

A cylindrical brush 391 comprising a rigid central axle 392 and radially projecting bristles 393 is located above the upper surface of the bricks as in array 437. The axle 392 is supported transversely of the direction of movement of the pallets as 336 and the conveyor 26. The cylindrical brush is operatively connected to a driving motor therefor as 30' which is also connected to the conveyor 26.

The lowest ends of the brush 391 are in brushing contact with the top surface of the array 437, i.e. the array of uncured bricks which have been coated as shown for array 436 in FIGS. 12 and 15. The brush support means is vertically adjustable to provide for sufficiently forceful contact that the brush 391 and the upper most brick surface so as to be able to spread the slurry over the top of the brick, while not effecting such a forceful contact between the brick and the rotating brush as might knock the brick down or cause misallignment of bricks on the pallet, which pallet is subsequently sent into a kiln. The conveyor moves at a maximum, although relatively uniform speed, of 2 to 3 inches per second after it gets started and during most of its travel. The brush, with a 1 foot diameter, rotates at a substantially even rate of 120 r.p.m. and so provides for an even spreading of the still wet slurry on the top face of the uncured brick so that such slurry is spread over the entire top face thereof as shown in FIG. 13.

The pressure in line 359 is set and controlled by a pressure control valve 346 and gauge 346G with a cut off valve 346V (FIG. 15).

Figure 13:
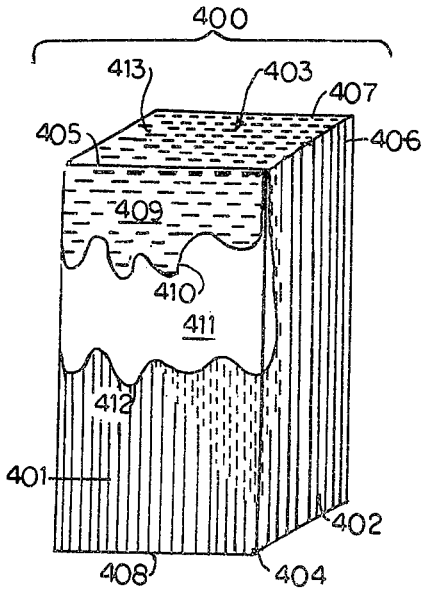
FIG. 13 is a top oblique view of a brick 474 formed according to this invention.

Apparatus 322 provides for applying the slurry to all the bricks in an array or group as 436 but only to one vertical face of each such brick, as shown in FIGS. 12, 13 and 15, rather than to two faces of some of the bricks in such array as shown in FIGS. 1 and 6.

In apparatus 322, the slurry from the nozzle assemblies 357 and 357A is applied to alternate passageways as 171 and 175, which passageways extend transversely to the direction of movement of the array as shown in FIGS. 12 and 15. As shown in FIG. 16, where the grid orificies 464B, 464C, 464D and 464E (corresponding to the orifices 463 of guide element 449) extend parallel to the length of conveyor 26 and parallel to the length of the vertical passageways 181, 183, 185 and 187, which passageways extend parallel to the length of the conveyor 26 and which passageways or alternate passageways between the bricks of the array. It is within the scope of the invention, that the guide elements such as 449 and 449A be duplicated as 449B, 449C, 449D and 449E to provide sufficient guide elements with a structure as 449 and with each such guide element having a nozzle assembly as 457, located thereabove on a support assembly as 444 of the nozzle support assembly 358 to maintain the nozzle assembly in the same alignment with the guide element (as 449B, 449C, 449D and 449E) as is provided by the assembly 444 for assemblies 457 and 457A to the guide units 449 and 449A.

In the operation of apparatus 329, each successive array of bricks as 435, 436, each of which array is the same as the array of uncured bricks 29—four rows of eight bricks each as shown in FIGS. 1, 2, 4, 12 and 16—produced by the machine 21 is located on a pallet as 334 and is moved by the conveyor 26 towards and under the center frame 444 of the nozzle assembly support 458. The arrays, 29, 135, 136 and 435 are identical. The uncured blocks of the array 436 like 136 are arranged, as shown in FIGS. 1 and 2, in a transversely extending series of longitudinal rows of bricks, of which rows the front member is numbered 466, 467, 468, 469, 470, 477, 478 and 479 (FIG. 12) and such rows are separated from each other by longitudinally extending spaces as 181, 182, 183, 184, 185, 186 and 187 respectively which extend parallel to the length of conveyor 26 as shown in FIGS. 12 and 16.

For any one such row of such bricks as shown in FIGS. 1, 6, 14 and 15, the bricks 470, 472, 474, 476 in each such row extend parallel to length of conveyor 26 and are separated by transversely extending spaces 471, 473 and 475; the spaces 471, 473 and 475 extend transversely across the entire array as for array 29. Each successive array of bricks, as 29, is moved from assembly 21 along successive positions on conveyor 26 for arrays 435 and 436. The slurry is applied to the array at the position thereof on conveyor 26 below nozzle assembly 357 and 357A as shown as 436 in FIGS. 12 and 15. The array 436, as well as conveyor 26, are then stationary according to one embodiment of this invention.

In the position of array 137, the distance between each pair of adjacent bottom edges of openings as 463 and 464 has its center in a position which is vertically over the center of the spaces as 471 and 475 between the rows of brick therebelow. Thereby the members 451, 452, 453 and 454 serve to guide the slurry passing from the nozzle assemblies 357 and 357A to the transversely extending spaces as 471 and 475 between the longitudinally spaced bricks as 470 and 472 and between 474 and 476 of each longitudinally extending row off bricks (as the longitudinally extending rows represented by the front members thereof 466, 467, 468, 469, 477, 478 and 479 as well as 470) in the array as 436, and shown after treatment as array 437.

The nozzles 473, 474, 475 and 475A are identical to 73–75 and are adapted for spraying of slurries.

The upper surfaces 451, 452, 453 and 454 of the transversely extending members are fully covered by a smooth layer of enamel paint: the slurry does not adhere thereto. The surface may be otherwise prepared or treated for such effect to achieve a selectively differential wetting action by the atomized slurry particles whereby the slurry selectively adheres to the concrete brick surface but not to the guide surfaces of grid assembly 449 or 449A.

The block making machine 21 automatically and continually produces a group or array of green blocks, as 29, every 15 seconds as described in U.S. Pat. Nos. 3,621,086 and 2,366,780. On completion of each cycle of production of such an array, 29, that group or array is placed on a pallet, as 334 and that pallet and group or array are moved along conveyor 26; accordingly, the group or array 29 is moved by a series of stepwise translations along conveyor 26 to successive positions, as shown for arrays 435, 436 and 437 in FIGS. 12 and 15 and located in each such position for the period of time required for production of another group or array of uncured bricks as 29; after such period of time each array is moved to the next position: during such period of time the array is stationary. When the array of uncured blocks is below the nozzle assemblies 357 and 357A and is stationary slurry is applied thereto from the assemblies 357 and 357A by operation of the slurry assembly 322 to produce a composite structure for each slurry-coated bricks as shown in FIGS. 12, 13 and 15. The resulting slurry coated bricks are then passed into kiln 31 and formed into fired or cured bricks with a partial coating of a glazed slurry.

Figure 14:
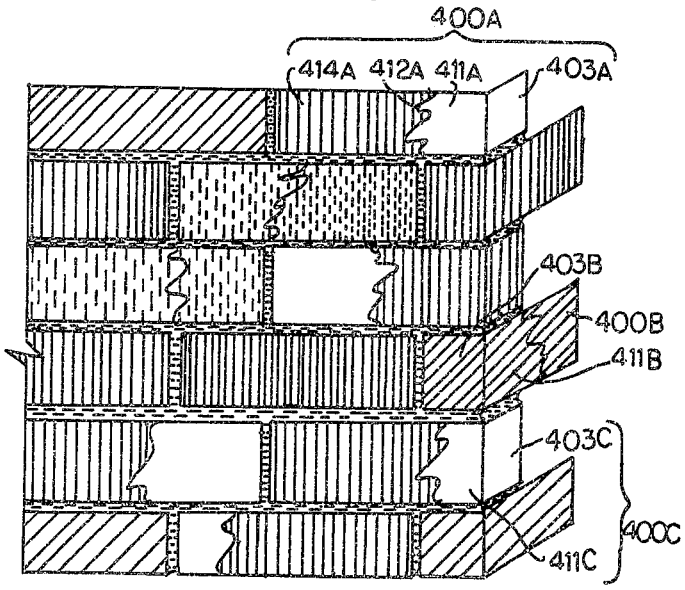
FIG. 14 is a portion of a brick wall formed of the coated bricks formed by this invention.

The operation of the apparatus 322 provides a selective application of the slurry to limited portions of the concrete bricks in the array as 437 below the nozzle assemblies 357 and 357A which results as is shown in FIGS. 12–14, as in FIGS. 2, 4 and 6, in a partial fractional coverage of selected faces of the brick (as faces 201 and 203) of brick with the slurry which is composed of small sized particles. The slurry so applied and located on curing forms a relatively smooth surfaced strongly colored glazed zone with a sharply defined edge; the bright color and smooth texture of such glazed zone are accentuated by the immediately adjacent coarser and relatively duller or differently colored concrete surface.

The cured slurry is the same as in apparatus 22 and has a coefficient of thermal expansion that is slightly different from the body of the brick, no resultant substantial stress develops because the partially coated bricks are only 2½ wide and are separated by mortar, and the fired slurry has substantially the same coefficient of expansion as the mortar between the bricks.

The operation of apparatus 322 on injection of slurry from one pump, as 347, (or more than one pump as 347, 348, 349 and 349A) each nozzle as 373, 374, 375 and 375A atomizes the slurry fed thereunto into small spheroids substantially all of less than one-sixteenth inch in diameter as above described for apparatus 22 (at pages 16–18).

The process of apparatus 322 as that of apparatus 22 thus coats a portion of surfaces of each concrete brick in array 436 by a sharply delineated cementitious layer. The timing of the sprays is as above described for assembly 22.

FIG. 12 shows the group 438 (like group 437) of coated uncured bricks separated from the remainder of the blocks of such group along a transverse passageway 475', which passage corresponds to passages 475' and 75 of groups 437 and group 137 respectively. The scope of different shapes and sizes of each of the cement layers as B, D, F, H, J, L, N and P on bricks A, C, E, G, I, K, M and Q respectively is thereby shown. It will be noted that each of the layers B, D, F, H, J, L, N and P are of different sizes and shapes, although concurrently made in the same apparatus. Changing the position of the nozzle assemblies 357 and 357A along the length of bars 457 and 457A respectively and/or changing the height of the bars 457 and 457A relative to the bricks below the guide unit 449 and 449A may further change the shapes of such layers and the relations of such shapes to each other so as to continually and repetitively and produce coated bricks of such varied shapes of cement layer.

FIG. 14 shows an array of bricks made according to this invention and arrayed as a wall and adjacent to a corner or edge. The brushing action of the brush 391 above described to cover one upper end of a brick provides that each of the small area ends (as 403 in brick 400 in FIG. 13) or 403A of brick 400A and 400B of brick 400C and end 403C of brick 400C are covered with a layer formed by the spreading of the cement by the brush 391 as above described.

In operation of apparatuses 22 and 322, the air pressure in line 59 (and 459) keeps the flexible diaphrams (as 117 or 417) firmly pressed against the shoulders as 131, 132 and 133 in the nozzle assemblies (as 57, 357 and 357A) when the valves as 43, 44 or 45 in assembly 22 and valves 343, 344, 345 and 345A in apparatus 322 are positioned to keep the pump chambers as 85 of each pump 47 and like chambers in pumps 48, 49 (and 347 - 349A) open to the atmosphere. As the diameter of each piston head 89 in pump as 47 is much larger than the diameter of piston 91, on turning of valve therefor, as 43, to pass the air pressure of tank 41 to chamber 85, the force on piston 91 creates a pressure in line 63 far in excess of the pressure applied by line 59 to diaphram 117 and accordingly rapidly forces the diaphram 117 from blocking relationship to orifice 131 and passes slurry under high pressure to the corresponding nozzle assembly as 57 (or 357 or 357A). On lowering of pressure in line 63 on turning each valve as 63 to its position to exhaust chamber as 85 to the atmosphere, each corresponding valve diaphram portion closes over the corresponding orifice 131 and prevents leaking and dripping from the associated nozzle as 73 as well as preventing leaking and dripping from the orifice 131 notwithstanding the abrasiveness of such thick slurry. On each movement of valve as 63 to a position to exhaust a chamber as 85 to the atmosphere, the slurry tanks 53, 54 and 55, which are open to atmosphere, force the slurry into each piston chamber of 78 of pump 47 and so provide for filling each such pump preparatory to activation as by valve 43 which valve, in turn, is actuated by switch as 251 of a control system as 268 when each array of the to-be-treated bricks, as 136 (or 436) is located under the slurry nozzle assembly therefor as 57, 357 or 357A as above described.

The apparatus 322 and the apparatus 22 accordingly provide for a main or primary coating cement layer of one color as that in zone 411 of brick 400 of FIG. 13 and a differently colored secondary or accent cement layer as in the area 409. The second or accent layer is applied to a portion of the zone 411 of the brick; the primary layer as 411 covers a larger area of the brick face 401 and the secondary layer 409 covers a smaller portion of that same area 401 as shown in FIG. 13. Such two-layer covering or coating is accomplished by having the timer 242 (FIG. 11) provide for two separate steps of slurry spraying. Inasmuch as each of the arrays of brick as 137 or 437 is located under the spray assembly 57 or 357 and 357A for a period of 5 to 7 seconds and slurry spray time duration is, as above described, only ½ to 1 second, after a first application of slurry spray onto the surfaces of the bricks as shown in FIG. 12 and FIG. 6 for a period of ½ to 1 second, a second application of a differently colored cement slurry as 95 is achieved by utilizing the switch 260 as a step switch and providing a different color composition as of cement slurry to the bricks under the guide elements as 449 and 449A or 149. The second layer of slurry, as 409, is applied to the brick below the guide element 449, 449A or 149, as above described for the first layer and accordingly a second color is applied thereto.

The components used in one example to make the bricks 29 are set out in Table I.

The dimensions of the apparatus 22 and 322 are set out in Table II.

Composition of one example of the slurry 95 is set out in Table III.

Dimensions of the product are set out in Table IV.

The process of U.S. Pat. No. 3,621,086 is a process for repeatedly and concurrently making a plurality of concrete bricks of differing surface appearance which process comprises the cycle of steps of filling each of a plurality of vertically extending chambers in a mold with concrete mix, vibrating the mold and compacting the concrete mix in each of said chambers to form a plastic mass, removing each said plastic mass from the mold and thereafter curing each said plastic mass, said cycle of steps of filling, vibrating and compacting and removing being completed within 15 seconds, and which process comprises the process step of spraying the mold surfaces of each chamber for a period of 0.3 to 1.0 seconds with a first fluid liquid slurry comprising cement and a first pigment prior to each filling of each said chamber of said mold with said concrete mix and thereby distributing said liquid slurry over the surface of said plastic mass adjacent said mold and then repeating the above cycle while performing the said process step with a second slurry comprising cement and a second pigment and thereafter repeating the above cycle automatically with each of a series of different composition of pigment in said slurry. In the process the slurry is sprayed in the amount of 3/70 gallon of liquid per each 100 square inches of mold surface and each 20 gallons of said liquid contains 5 to 10 pounds of cement and 5 to 20 pounds of pigment. Such process provide concrete facing brick with the colored components and the support components mutually interpenetrating at the surface of the bricks and the color components of the concrete being specifically distributed on the brick surface according to a variety of plans and effects.

The motor 30' of conveyor 26 in assembly 320 and assembly 20 is usually driven by an electrically powered circuit that is triggered by movement of stamp support frame 19 of blockmaking machine 21 and moves the blocks of arrays 36 and 336 and the like along conveyor 26 in synchronism with the operation of the machine 21 so that each array as 36 and 336 is stationary under the stationary nozzle support assemblies 58 and 358.

The size distribution of the aggregate used for the concrete brick is given as table I below.

TABLE I

| Sieve Size | Gravel | Sand | Silica | Total |
|---|---|---|---|---|
| −1/2 | 100 | | | 100 |
| −3/8 | 98 | 100 | | 99.6 |
| −04 mesh | 20 | 97 | | 81.6 |
| −8 | 2 | 85 | | 68.8 |
| −16 11 | 1 | 73 | | 59.5 |
| −30 | | 53 | | 44.1 |
| −50 | | 18.6 | | 17.9 |
| −100 | | 3.8 | 100 | 6.7 |
| −200 | 0.66 | 1.8 | 89.5 | 5.4 |
| Total weight | 20.2% | 76.0 | 3.8 | |

The percentage of cement (by weight for the concrete mix of table I is 10 percent (A.S.T.M. type I, physical and chemical properties in A.S.T.M.C-150-41).

TABLE II

DIMENSIONS OF APPARATUS 22

| | | |
|---|---|---|
| Assembly 57: | | |
| width | | 2 5/8" |
| length | | 6 1/2" |
| depth | | 4" including nozzles |
| chamber 113 | o.d. | 1 1/2" |
| shoulder 123 | i.d. | 7/16" |
| | o.d. | 3/4" |
| chamber 127 | i.d. | 3/4" |
| | o.d. | 1 1/2" |
| | depth | 3/16" |
| diaphram sheet 117 | thickness | 1/8" |
| | material | Neoprene |
| | description | |
| Unit 449: | | |
| inside width (opening 461) | | 7 1/2" |
| inside length (opening 461) | | 22 3/4" |
| Member 451: | | |
| width (162–163) | | 3 1/2" |
| height (162–163 to 197) | | 6" |
| face length (192) | | 6 1/4" |
| spacing (163–164) | | 5/8" |
| Frame 58: | | |
| bottom of nozzle 73–75 to edges 162–163 | | 17 1/2" |
| Spacing: | | |
| edge 162 to brick surface | | 3/4" |
| Pipe 63, 64, 65: | | |
| i.d. | | 5/16" |
| length | | 15' |
| usual pressure | | 90 p.s.i.g. |
| Pump 47: | | |
| effective diameter of piston head plate 89 | | 5.3" |
| effective diameter of piston 91 | | 2.7" |
| pressure in line 52 | | 15 p.s.i.g. |
| spring 88 (No. 231522 WABCO) | | 18 p.s.i. |
| Curing time and temperature in kiln 31 is conventional as set out in U.S. Pat. No. 3,252,200, i.e. curing at 180°F. and further treatment in a high pressure kiln at 300°F. to 400°F. or by process of U.S. Pat. No. 3,252,200. | | |
| Array 136 and 436: | | |
| width of passageways 171, 173, 175 and 181 through 187 | | 3/8" |

TABLE III

COMPOSITION OF SLURRY MIX 95

| | | | |
|---|---|---|---|
| water | | 44.3 | % by weight |
| dispersant | *Attapulgite colloidal suspending (agent) | 2.1 | |
| definition | | | |
| sand: | Silica Flour | 33.2–23.2 | |

TABLE III-continued

COMPOSITION OF SLURRY MIX 95

| | | |
|---|---|---|
| size range | (600 mesh) | |
| cement: | | 20.4 |
| type | (type II A.S.T.M.) physical and chemical properties in A.S.T.M C-150-4 | |
| pigment (chromatically colored) | | 0–10 |

Sample pigments used are:

(a) Black - MB222, a precipitated ferroso ferric oxide of composition $FE_3O_4$, cubical particle shape and having a hiding power of 1,250 square foot per pound, a size of less than 10% plus 325 mesh and an average particle size of .2–.4$\mu$ and specific gravity of 4.96, and (b) Brown - 5250, a composition of $FE_2O_3$ (88–95%) described in Federal specification B-4075, TTP405, less than 10% plus 325 mesh.

Similarly finely divided red, yellow, orange and salmon colored iron oxides and/or green chromic oxides may be used.

*attapulgite is a fuller's earth of Attapulgus, Georgia U.S.A. with a chain structure. Chemical analysis thereof is provided at page 136 of Industrial Minerals and Rocks, American Institute of Mining and Metallurgical Engineers, 1937.

TABLE IV

DIMENSIONS OF PRODUCT (REFERENCE NUMERALS AS IN FIG. 5)

| | | |
|---|---|---|
| length (normal to 203) | 3" | 3" |
| width (normal to 206) | 2 5/8" | 2 1/4" |
| height (as in FIG. 5) | 8 5/8" | 7 5/8" |
| height of area 230 (edge 236 to 229-A) | | |
| Maximum | 7 5/8" | 3" |
| Minimum | zero | |
| thickness of area 230 layer | | 1/16" |
| length of area 214 (to rear of corner 237) | | |
| Maximum (after brushing) | total top area | |
| Minimum (before brushing) | 1/2" | |
| thickness of area 215 (below corner 237) | 1/32" | |
| Maximum | 1/16" | |
| Minimum | zero | |

I claim:

1. A process for repeatedly and concurrently making a plurality of colored and coated concrete bricks of differing surface texture and color which process comprises the cycle of steps of a. filling each of plurality of verically extending chambers in a mold with concrete mix, vibrating the mold and compacting the concrete mix in each of said chambers to form a plurality of plastic concrete brick masses, and spraying the mold surfaces of each chamber with a first fluid liquid slurry comprising cement and a first pigment prior to each filling of each said chamber of said mold with said concrete mix and thereby distributing said liquid slurry over surfaces of each of said plastic concrete brick masses adjacent said mold and thereby coloring each of said plastic brick masses prior to removal of each of such plastic masses from said mold; then b. removing thus-coated brick masses from the mold to thereby provide and thereafter maintaining a longitudinally and transversely extending array of a plurality of vertically extending spaced apart brick masses of predetermined width, depth, and height having between the separate brick masses in said array vertically and longitudinally extending spaces and vertically and transversely extending spaces, said spaced being narrow relative to said width, depth, and height of said brick masses said array of brick masses having between longitudinally neighboring masses of said array longitudinally and horizontally spaced apart parallel transversely and vertically extending surfaces and between transversely neighboring brick masses horizontally and transversely spaced apart parallel longitudinally and vertically extending surfaces, said vertically extending and relatively narrow spaces located between said vertically extending surfaces;

c.

i. preparing a viscous pigmented cementitious slurry thickened to be selectively adherent to a hydrophyllic wet surface, ii. then periodically pressurising and atomizing said viscous pigmented cementitious thickened slurry and forming, at a spray source, a stream of small globules of atomized slurry and, while said brick masses are in a fixed spatial relation to said spray source, directing the said stream of small globules of atomized slurry towards and between and against aa. a pair of inwardly sloped guide surfaces, said pair of guide surfaces having a wide opening at its top and a narrow opening at its bottom, said lower opening located above and parallel to the upper edges of a pair of said vertically extending spaced apart surfaces of neighboring brick masses in said array of plurality of spaced apart plastic concrete brick masses, each of said sloped guide surfaces having a slurry repellent surface and located above said vertically extending mass, and said guide surfaces of each said pair of guide surfaces having a common line of intersection below the top surface of said array of spaced apart vertically extending brick masses and within the vertically extending space located between said pair of vertically extending surfaces, and wherein a flat planar extrapolation of each of said surfaces of said pair of guide surfaces extends above the said upper edge of said vertically extending spaced apart surfaces of neighboring brick masses and bb. into said vertically extending and relatively narrow spaces between said spaced apart vertically extending surfaces of neighboring brick masses in said array of a plurality of plastic concrete brick masses below said guide surfaces, and developing a turbulent flow of said stream of small globules at the top of the said vertically extending spaces and thereby then iii. applying said small globules of atomized slurry selectively to a portion of a vertically extending surface of each of said plastic concrete brick masses in said array in an amount sufficiently thin to be static on said surface of said plastic concrete brick mass and sufficiently thick to provide an optically opaque layer, said portion of said vertically extending surface of each of said plastic concrete brick masses for each of such masses extending from an upper edge of said mass, said upper edge joining two corners of said mass and the contiguous area of a vertically extending surface thereof adjacent to said upper edge to a lower lobular edge, said lower lobular edge spaced away from the bottom edge of said brick, and providing a sharp delineation between each said optically opaque layer and the area of said plastic concrete brick mass surface therebelow.

2. Process as in claim 1 including the step of firing said array of brick to which said small globules were applied to form a plurality of cured concrete bricks, each with a surface having partial coating of a strongly colored glazed slurry and a different color and texture than said surface of said brick and a strong line of delineation therebetween.

3. Process as in claim 1 wherein said small globules of atomized slurry are applied also to a horizontally extending edge joining two upper corners and the contiguous area of a horizontally extending face adjacent to said horizontally extending edge followed by the step of forming said small globules of atomized slurry into a layer of said viscous cementitious slurry on said horizontally extending edge and spreading said layer over the entire surface of said horizontally extending face.

4. Process as in claim 1 wherein the duration of time of said period of atomizing said slurry and directing it against, towards and between said pair of guide surfaces into said relatively narrow spaces between said brick masses and applying said globues of atomized slurry to a portion of each of said brick masses is in the range of ½ to 1 second, and wherein said optically opaque layer has thickness of one-sixty-fourth to one-eighth inch.

5. Process as in claim 4 including the step of heating the guide surfaces and cooling of the brick surfaces.

6. A two layer covering process as in claim 4 wherein said small globules of atomized slurry are formed in a plurality of separate and distinct time periods and a. said small globules of atomized slurry first formed have one color and are for each of said plastic concrete masses applied to the area defined by said upper edge joining two corners and said lobular edge provides a sharp delineation between each said optically opaque layer and the area of said plastic concrete brick mass surface remaining therebelow, and b. a second of said plurality of small globules of atomized slurry formed in a second separate distinctive time period from the time period in which said first small globules of atomized slurry is formed have a different color from said one color and is similarly applied to a portion of said optically opaque layer formed by said first small globules of atomized slurry; and c. said vertical surfaces to which the small globules of atomized slurry are applied are moved in a direction normal to said surfaces before and after said application of small globules of atomized slurry to said extending surfaces to form a first coating layer with a line of demarcation between said lobular edge of said slurry and said cement surface and a second differently colored layer.

7. A process for repeatedly and concurrently making a plurality of colored and coated concrete bricks of differing surface texture and color which process comprises the cycle of steps of a. filling each of a plurality of vertically extending chambers in a mold with concrete mix, vibrating the mold and compacting the concrete mix in each of said chambers to form a plurality of plastic concrete brick masses, then b. removing said brick masses from the mold to thereby provide and thereafter maintaining a longitudinally and transversely extending array of a plurality of vertically extending spaced apart brick masses of predetermined width, depth, and height having between the separate brick masses in said array vertically and longitudinally extending spaces and vertically and transversely extending spaces, said spaces being narrow relative to said width, depth, and height of said brick masses said array of brick masses having between longitudinally neighboring masses of said array longitudinally and horizontally spaced apart parallel transversely and vertically extending surfaces and between transversely neighboring brick masses horizontally and transversely spaced apart parallel longitudinally and vertically extending surfaces, said vertically extending and relatively narrow spaces located between said vertically extending surfaces;

c.

i. preparing a viscous pigmented cemetitious slurry thickened to be selectively adherent to a hydrophyllic wet surface, ii. then periodically pressurising and atomizing said viscous pigmented cementitious thickened slurry and forming, at a spray source, a stream of small globules of atomized slurry and, while said brick masses are in a fixed spatial relation to said spray source, directing the said stream of small globules of atomized slurry towards and between and against aa. a pair of inwardly sloped guide surfaces, said pair of guide surfaces having a wide opening at its top and a narrow opening at its bottom, and lower opening located above and parallel to the upper edges of a pair of said vertically extending spaced apart surfaces of neighboring brick masses in said array of plurality of spaced apart plastic concrete brick masses, each of said sloped guide surfaces having a slurry repellent surface and located above said vertically extending mass, and said guide surfaces of each said pair of guide surfaces having a common line of intersection below the top surface of said array of spaced apart vertically extending brick masses and within the vertically extending space located between said pair of vertically extending surfaces, and wherein a flat planar extrapolation of each of said surfaces of said pair of guide surfaces extends above the said upper edge of said vertically extending spaced apart surfaces of neighboring brick masses and bb. into said vertically extending and relatively narrow spaces between said spaced apart vertically extending surfaces of neighboring brick masses in said array of a plurality of plastic concrete brick masses below said guide surfaces, and developing a turbulent flow of said stream of small globules at the top of the said vertically extending sapces and thereby then iii. applying said small globules of atomized slurry selectively to a portion of a vertically extending surface of each of said plastic concrete brick masses in said array in an amount sufficiently thin to be static on said surface of said plastic concrete brick mass and sufficiently thick to provide an optically opaque layer, said portion of said vertically extending surface of each of said plastic concrete brick masses for each of such masses extending from an upper edge of said mass, said upper edge joining two corners of said mass and the contiguous area of a vertically extending surface thereof adjacent to said upper edge to a lower lobular edge, said lower lobular edge spaced away from the bottom edge of said brick.

* * * * *